US005281021A

United States Patent [19]

Röck et al.

[11] Patent Number: 5,281,021

[45] Date of Patent: Jan. 25, 1994

[54] ARRANGEMENT FOR REMOVABLY MOUNTING A DRAWER TO PULL-OUT RAILS OF DRAWER GUIDE ASSEMBLIES

[75] Inventors: Erich Röck; Klaus Brüstle, both of Höchst, Austria

[73] Assignee: Julius Blum Gesellschaft m.b.H., Höchst, Austria

[21] Appl. No.: 592,543

[22] Filed: Oct. 2, 1990

[30] Foreign Application Priority Data

Oct. 6, 1989 [AT] Austria ..... 2313/89
May 19, 1990 [DE] Fed. Rep. of Germany ..... 9005705

[51] Int. Cl.[5] ..... A47B 88/00

[52] U.S. Cl. ..... 312/334.32; 312/330.1; 312/334.46; 403/107

[58] Field of Search ..... 312/330.1, 333, 334.8, 312/334.32, 334.46, 334.47; 384/22; 403/107, 106, 97, 329

[56] References Cited

U.S. PATENT DOCUMENTS

| | | | |
|---|---|---|---|
| 2,496,997 | 2/1950 | Hallberg | 312/348 X |
| 3,937,531 | 2/1976 | Hagen et al. | 312/348 X |
| 4,274,689 | 6/1981 | Vander Ley et al. | 312/348 X |
| 4,423,914 | 1/1984 | Vander Ley | 312/348 X |
| 4,473;262 | 9/1984 | Staye | 312/333 |
| 4,778,230 | 10/1988 | Lautenschlager | 312/348 X |
| 4,998,828 | 3/1991 | Hobbs | 312/348 X |

*Primary Examiner*—Brian K. Green
*Attorney, Agent, or Firm*—Wenderoth, Lind & Ponack

[57] ABSTRACT

A drawer has two drawer side frames to each of which a pull-out rail of a drawer guide assembly is releasably fastened. Each pull-out rail has at its rear end a hook by means of which it is engageable in the drawer. The drawer is provided with catch elements which engage on each side in a recess of the pull-out rail and abut on a catch edge of the pull-out rail. Each drawer frame has a hook member which receives the front end of the pull-out rail. Further, a number of stop surfaces staggered in a direction inclined to the pull-out direction of the drawer are formed on the catch elements. One of these stop surfaces abuts on the catch edge.

28 Claims, 9 Drawing Sheets

ARRANGEMENT FOR REMOVABLY MOUNTING A DRAWER TO PULL-OUT RAILS OF DRAWER GUIDE ASSEMBLIES

FIELD AND BACKGROUND OF THE INVENTION

The invention relates to a drawer with two drawer side frames to each of which a pull-out rail of a drawer guide assembly is releasably fastened. Each pull-out rail has at its rear end a hook by means of which the pull-out rail is engageable in the drawer. The drawer has catch elements which are resilient or acted upon by a spring and which engage in respective recesses of the respective pull-out rails and abut on catch edges thereof. Each drawer frame has a hook member receiving the front end of the respective pull-out rail.

The invention relates in particular to drawers with drawer guide assemblies having pull-out rails and supporting rails that are inseparable. In general, rollers or balls in such drawer guide assemblies are mounted in carriages.

The state of the art includes two types of drawer guide assemblies in which rollers thereof are not directly fastened to one of the rails, but rather are arranged in an individual carriage. Best known are so-called ball roller pull-out assemblies in which the transmission of load between the rails takes place by means of steel balls held in a carriage in the form of a ball cage. The other type of pull-out guide assembly, which has been introduced on the market lately, has cylindrical rollers of the type which normally are mounted directly at the rails. These rollers are, like the balls, held in a carriage which itself does not transmit forces.

Drawers and pull-out guide assemblies are known wherein it is possible to mount the full pull-out guide assembly including the pull-out rail or rails in the furniture body, and to engage the drawer with the pull-out rails subsequently. These arrangements allow easy disengaging of the drawer, for example for cleaning operations. Examples are shown in AT-PS 384 535 and in DE-GM 89 03 741.

To look the drawer on the pull-out rails, a resilient catch element of the drawer must engage in a recess of the pull-out rail. It is necessary for this purpose to align exactly the position of the recess in the rail and the position of the catch element on the drawer. In practice, inaccuracies occur frequently and prevent trouble-free engagement of the catch elements in the recesses of the pull-out rails. For example, the drawer guide assembly with supporting and pull-out rails may be mounted too far towards the front or towards the rear with respect to the depth of the article of furniture. This may be caused by a mounting error or by drilling errors in rows of holes which serve for mounting. In some cases, a buffer is mounted between the front of the drawer and the furniture body. The buffers usually have different heights so that the drawer extends into the furniture body to different extents.

SUMMARY OF THE INVENTION

It is the object of the invention to improve the mounting of such a drawer in the pull-out guide assemblies thereof. In particular, locking of the drawer on the pull-out rails should always be guaranteed when the drawer is being mounted into the pull-out guide assemblies. It is important in this respect that the push-in path of the drawer in the direction of the depth of the article of furniture be limited by the front plate of the drawer which abuts the front sides of the furniture side walls, even if the pull-out rails are not always absolutely precisely in the positions in which the catch elements rest against the catch edges of the pull-out rails.

According to the invention this is achieved by providing the catch elements with a number of stop surfaces which are staggered in a direction inclined to the pull-out direction of the drawer, one of such stop surfaces always being at a level to abut the catch edge.

A preferred embodiment of the invention provides a release member which is fastened at the drawer frame and arranged below the catch element. The catch element can be unlocked by means of the release member. This could also be done by hand without a special release member but only at the risk of injuring one's hand when extracting the drawer.

While it is possible that the stop surfaces form together a continuous inclined surface, a staggered arrangement of the stop surfaces is advantageously provided. Thus, one stop surface or step always will be in position to abut the catch edge when the drawer is mounted on the pull-out rails.

A further embodiment of the invention provides that the hook member of the drawer frame is directed opposite to the hook of the pull-out rail and that the release member is molded to the hook member. Thus, the front of the drawer also is secured against being lifted from the pull-out rails. The hook member also forms a stop for the drawer, and thus the release member always is definitely positioned.

BRIEF DESCRIPTION OF THE DRAWINGS

In the following embodiments of the invention will be described with reference to the accompanying drawings, in which.

DESCRIPTION OF THE PREFERRED EMBODIMENTS

Figure 4:
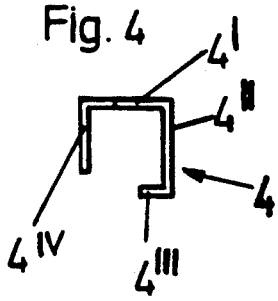
FIG. 4 is an end view of the pull-out rail.
Figure 5:
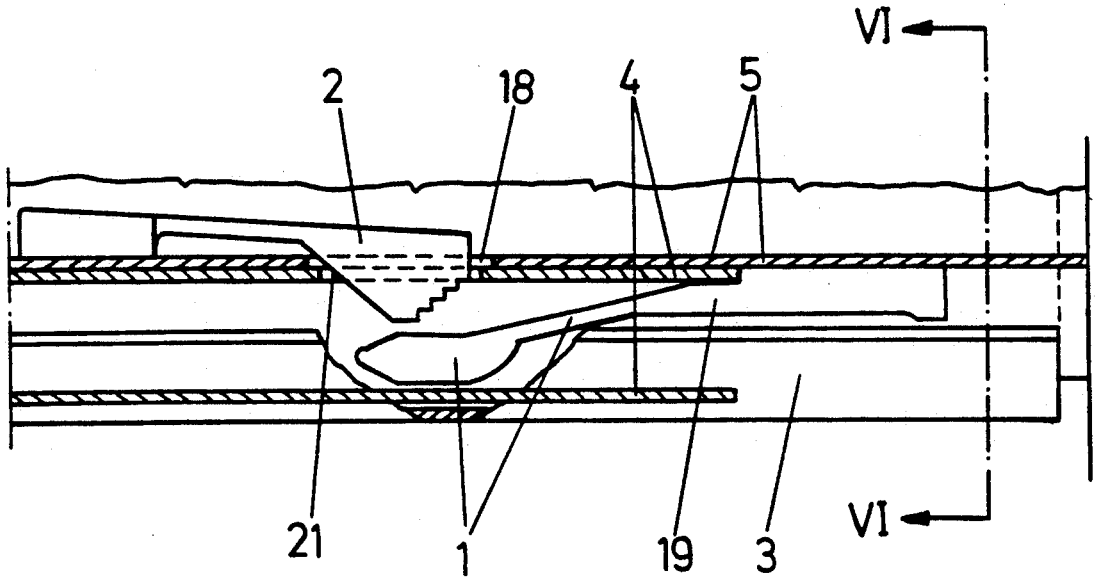
FIG. 5 is a sectional view along line V—V of FIG. 6.

A drawer according to the invention comprises in a conventional manner two drawer side frames 5, a rear wall 7, a base 6 and a front 8. The drawer frames 5 are advantageously of extruded aluminum, but they can equally be made of plastics material. Each drawer frame 5 is double-walled and has a lower horizontal cover flange 9. Further, the drawer frames 5 have horizontal flanges 10, 11 which embrace the drawer base 6. Also, each drawer frame is provided with a lateral cover flange 12 beneath which is insertable pull-out rail 4. The pull-out rail 4 comprises, as can be seen from FIG. 4, upper and lower horizontal flanges 4' and 4''', a continuous vertical flange 4'' on one side which connects the two horizontal flanges 4' and 4''', and a marginal flange $4_{iv}$on the other side extending downwardly from horizontal flange 4'.

Figure 1:
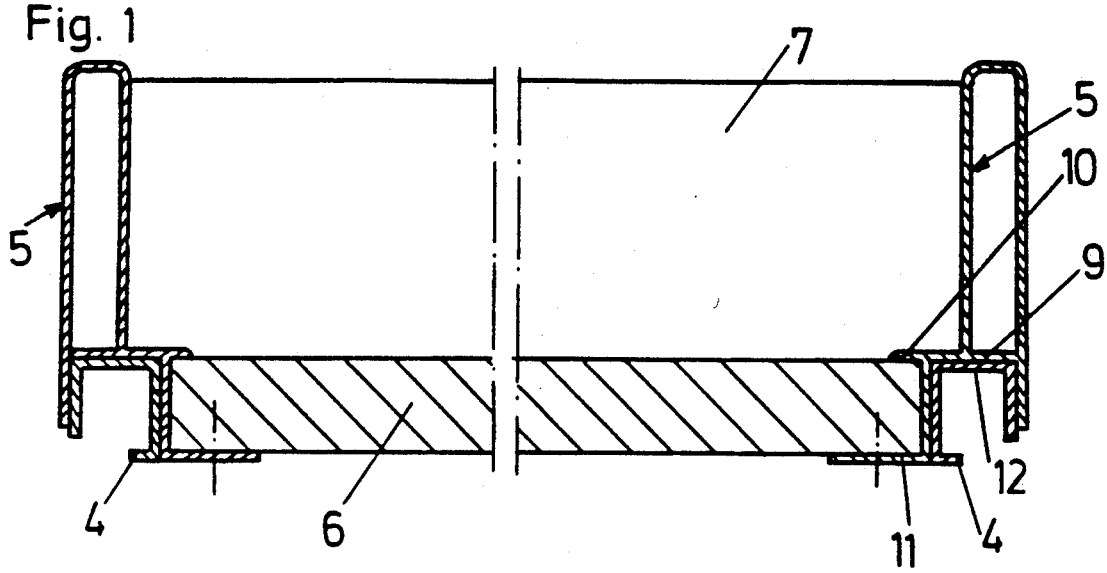
FIG. 1 is a cross-sectional view of a drawer according to the invention.
Figure 2:
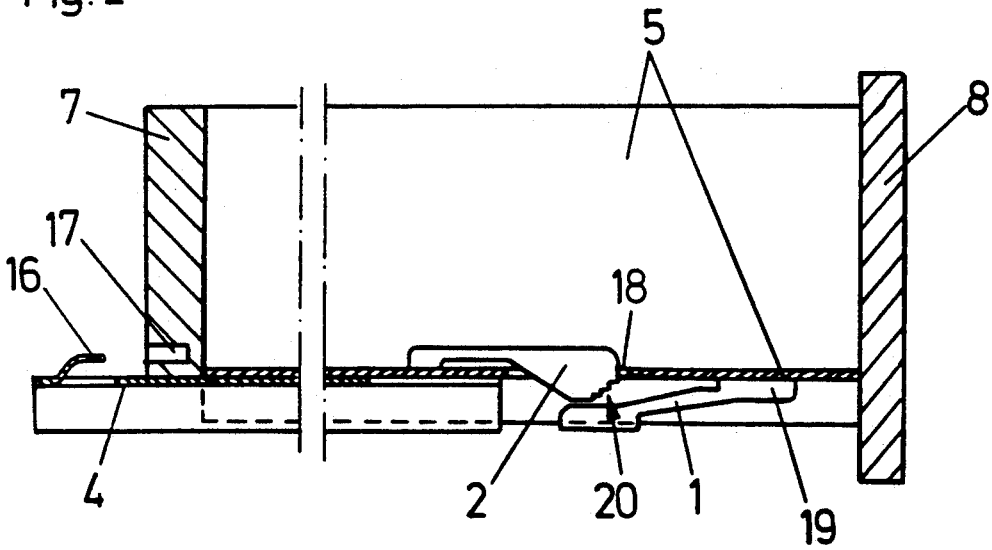
FIG. 2 is a longitudinal sectional view of a drawer according to the invention and of a first embodiment of a rail locking arrangement to the invention.
Figure 3:
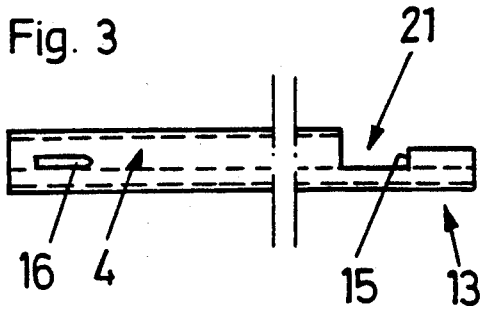
FIG. 3 is a top view of a front end of a pull-out rail.
Figure 13:
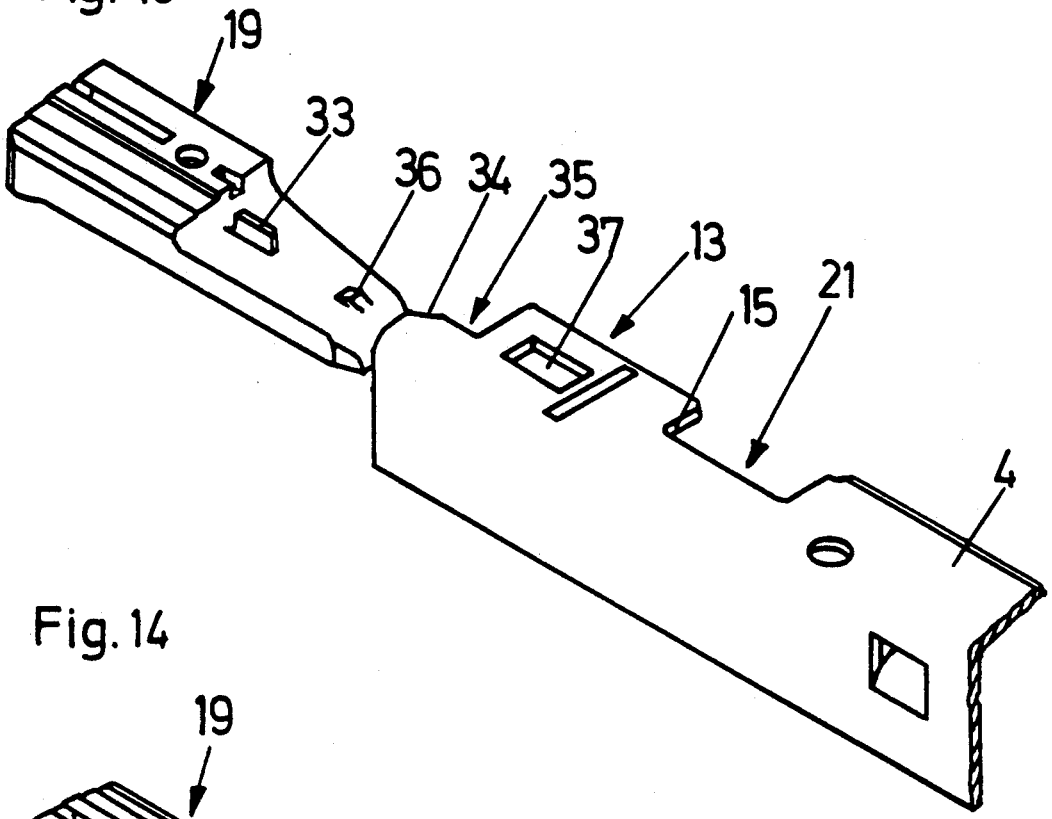
FIG. 13 is a perspective view of a left hook member and of a left pull-out rail.
Figure 14:
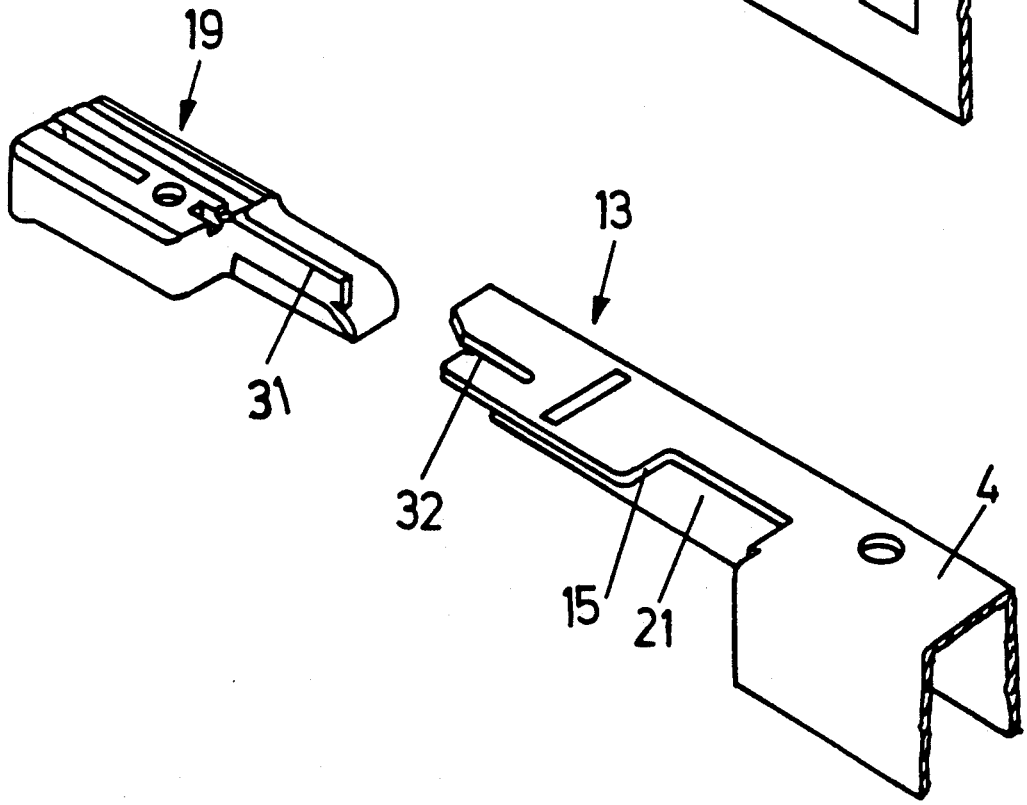
FIG. 14 is a perspective view of a right hook member and of a right pull-out rail.

As can be seen from FIGS. 3, 13 and 14, each pull-out rail 4 has a front end portion 13 of reduced width or horizontal dimension. A recess 21 having a catch edge 15 at its front end is provided in portion 13. At the rear each pull-out rail 4 is provided with a hook 16 which engages, when the drawer is being mounted on the pull-out rail, in an aperture 17 in the rear wall 7 of the drawer or directly in drawer frame 5.

The horizontal flange 9 of each drawer frame 5 has a front region provided with an opening or perforation 18. A resilient catch element 2 extends through perforation 18. In the embodiment according to FIGS. 2 to 9 catch element 2 is mounted directly to the drawer frame 5 and has at a front portion thereof, i.e. directed towards the front 8, a plurality of stop surfaces 20 disposed in an arrangement that is staggered downwardly and rearwardly.

A release member 1 is arranged below the catch element 2 and below the horizontal flange 9 of each drawer frame 5. The release member 1 is made as an integral piece with a hook member 19, and like the catch element 2 may be injection molded of a plastic material. Any other suitable material also can be used. Elements punched from sheet metal can be used, for example.

Figure 8:
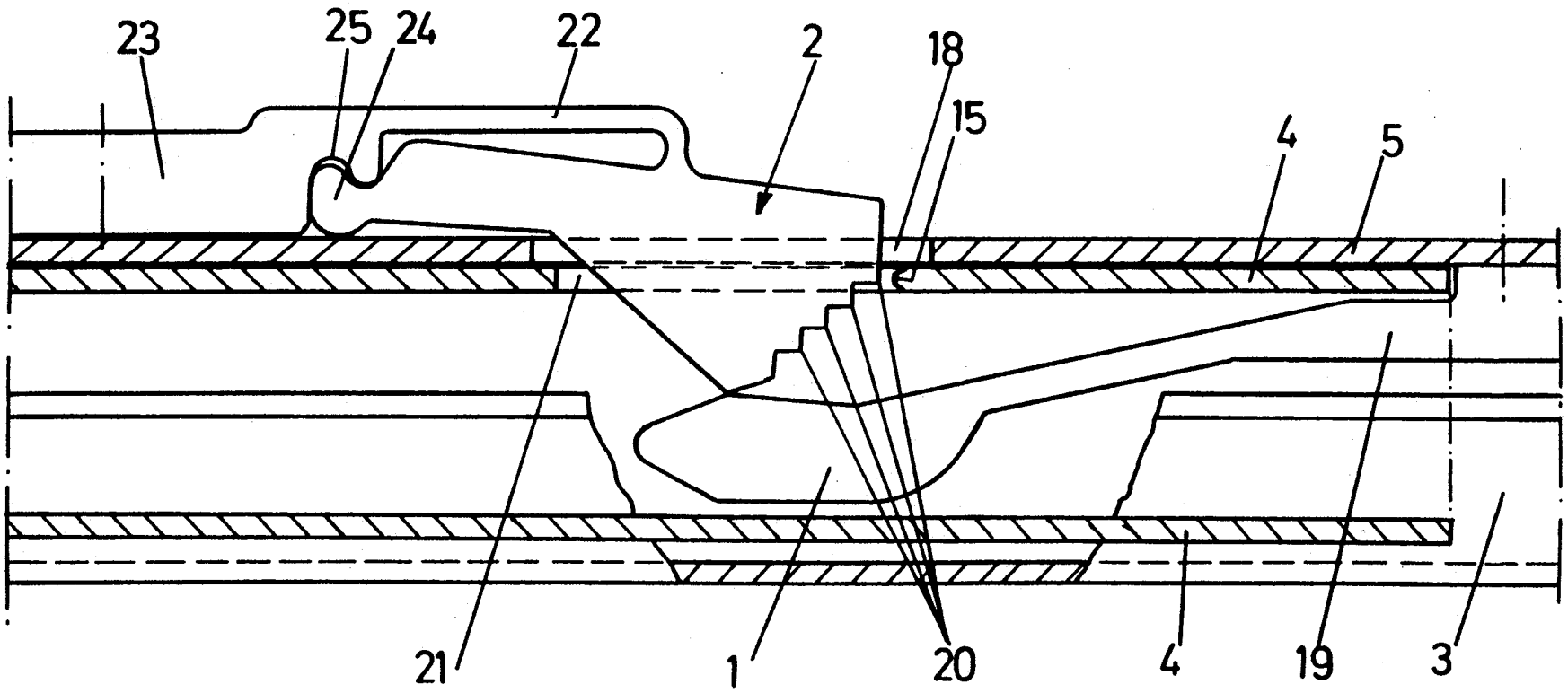
FIGS. 8 and 9 are vertical sectional views of the drawer frame and the pull-out rail in the region of the catch element and the release member.
Figure 9:
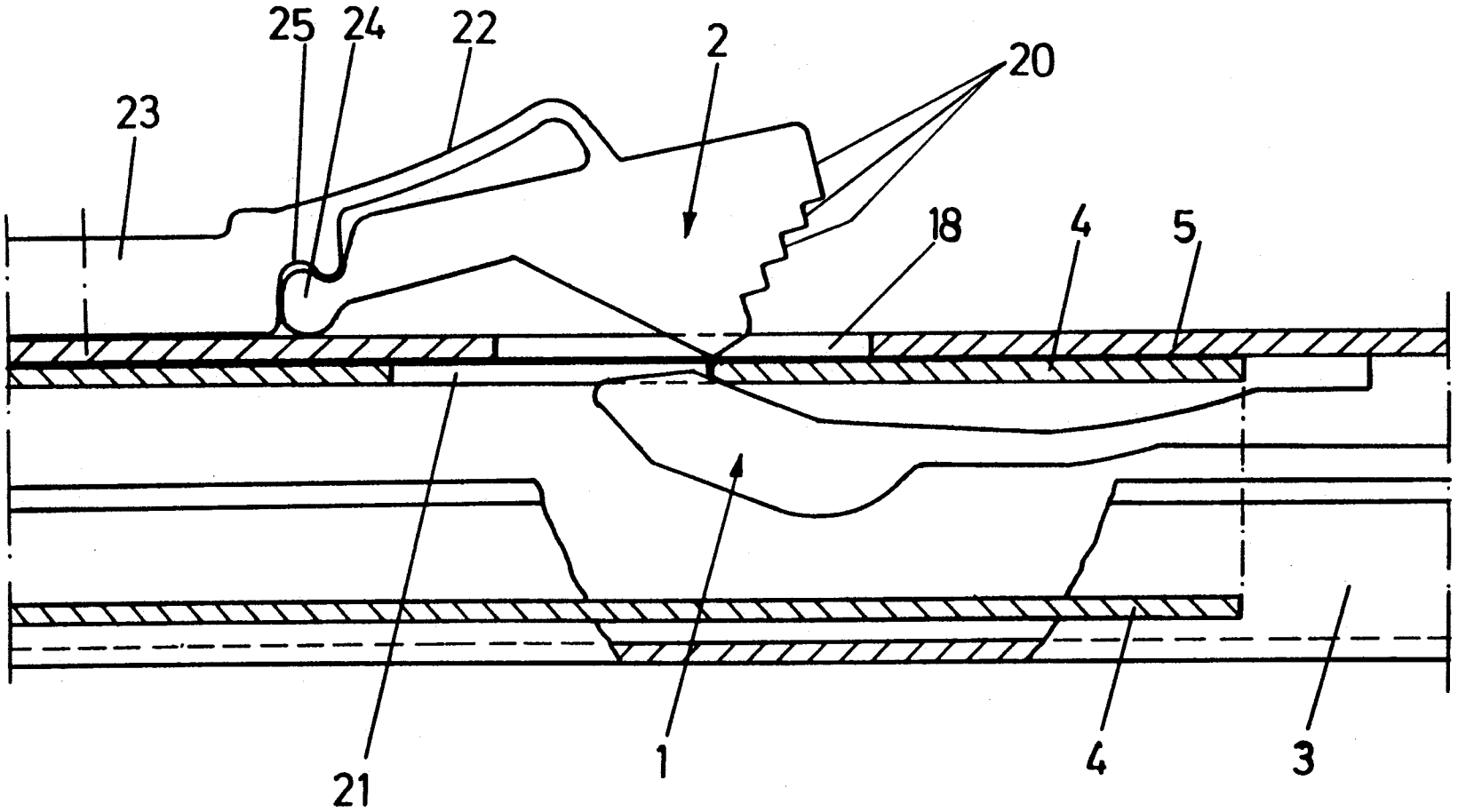
Figure 10:
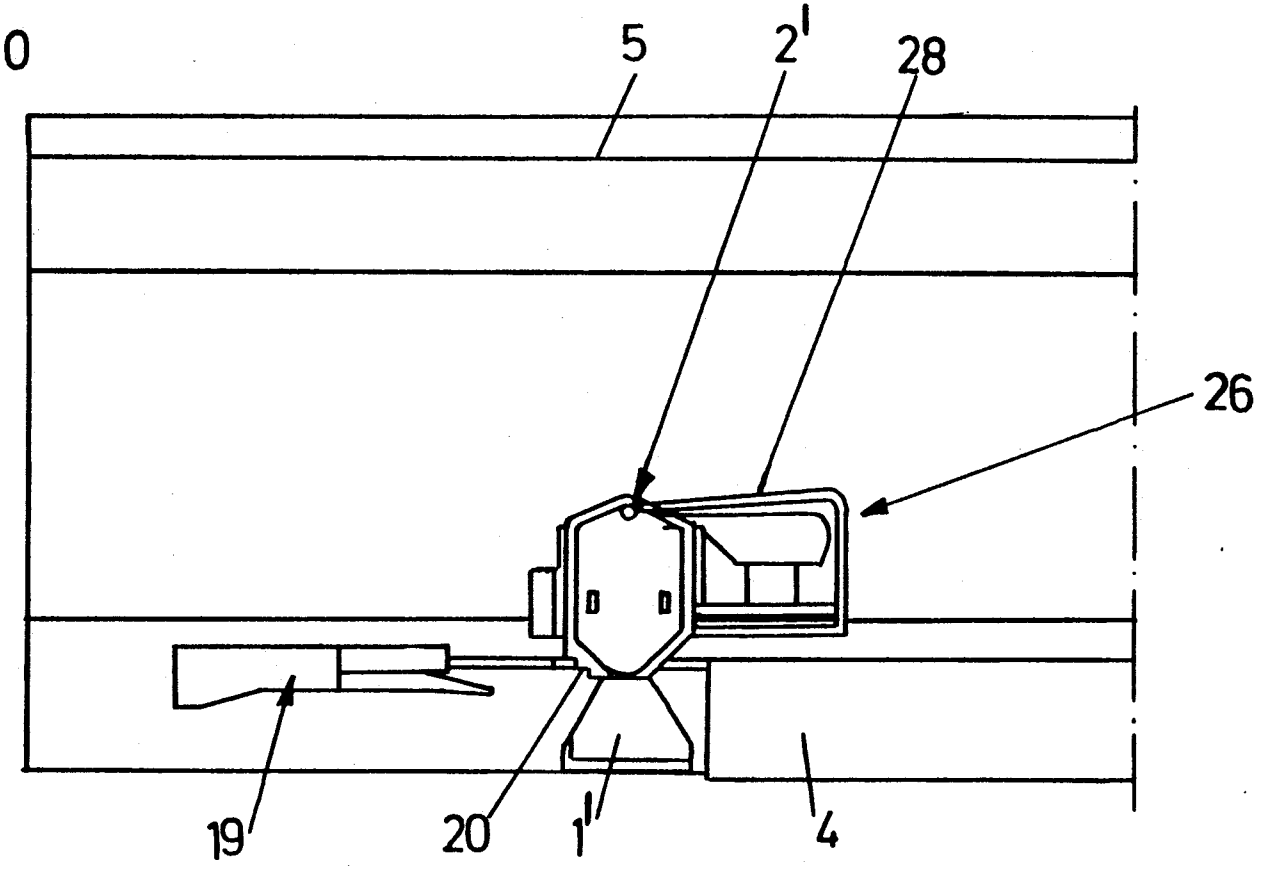
FIG. 10 is a side view of a drawer frame with a second embodiment of a rail locking arrangement.
Figure 11:
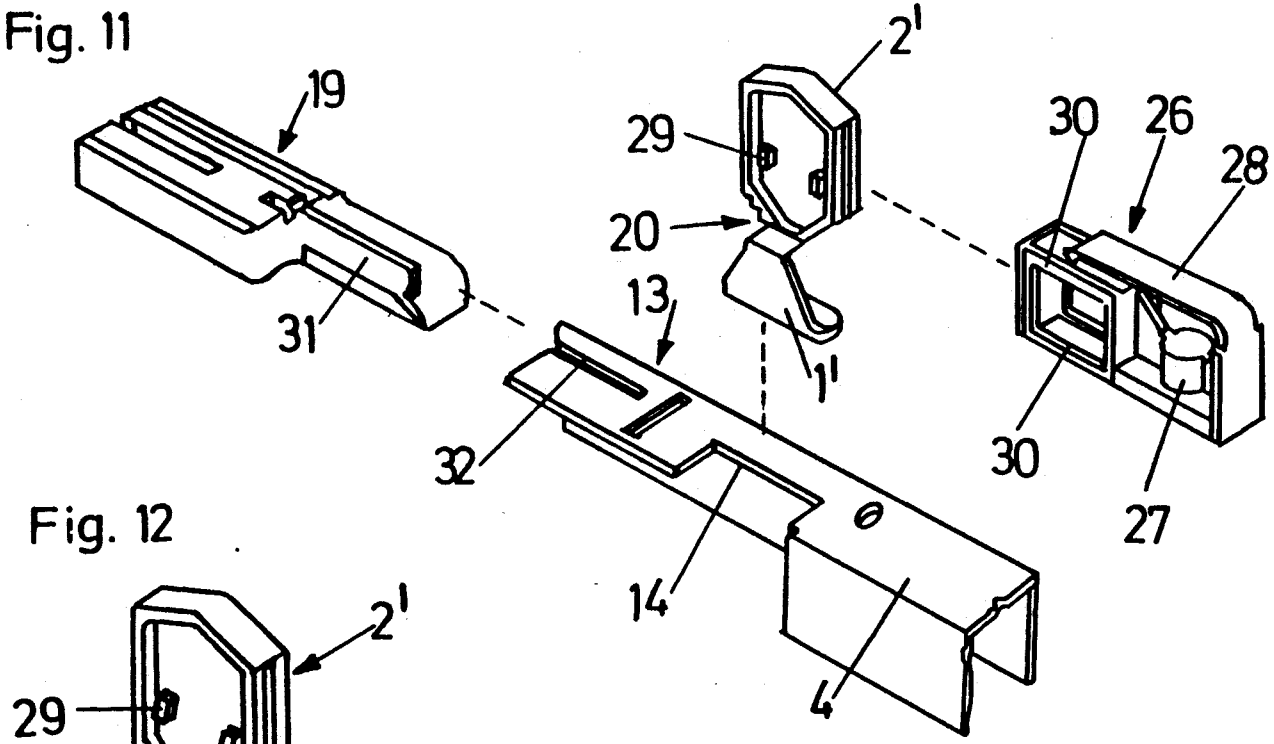
FIG. 11 is an exploded perspective view of the parts of the rail locking and of the pull-out rail.
Figure 12:
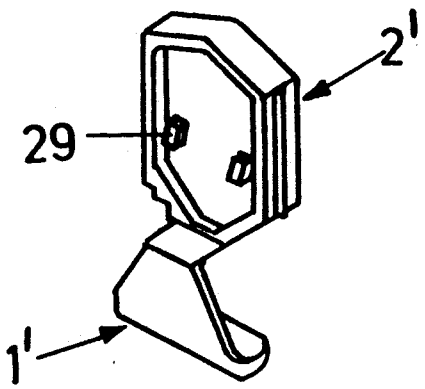
FIG. 12 is an enlarged perspective view of a catch element and of a release member of this embodiment.

When the drawer is being mounted on the pull-out rails 4, front ends of rails 4 are pushed into the hook members 19, as can be seen from FIG. 8. As a result, the front of the drawer is secured against being lifted from the pull-out rails 4. At the rear the hook 16 of each pull-out rail 4 extends into the corresponding opening 17 in the rear wall 7 of the drawer or in the respective drawer frame 5. The drawer thus is secured against being lifted from the pull-out rails, but could be pushed from its locking position. This is prevented by providing the catch element 2 that is mounted within the drawer frame 5 and projecting through the perforation 18 in horizontal flange 9 of frame 5 and the recess 21 in the pull-out rail 4, and one of the stop surfaces 20 of the catch element 2 coming into abutment with catch edge 15 of recess 21 in the pull-out rail 4. Thus, the pull-out rail 4 is secured against longitudinal displacement relative to the drawer frame 5.

To be able to remove the drawer fully from the furniture body and to release it from the pull-out guide assembly, the catch element 2 simply has to be pressed out of the recess 21 in the upward direction. The release member 1 is provided directly below the catch element 2 to prevent injury to the hand of a user The person handling the drawer presses on the release member 1 and thus lifts teh catch element 2 from the recess 21. The hand of the thereby will not be injured by the pull-out rail 4. As already mentioned, the catch element 2 as well as the release member 1 and the hook member 19 advantageously are injection molded of a plastic material.

The catch element 2, which in lateral view is substantially fan-shaped, is connected to a mounting block 23 by means of a holding or support arm or flange 22. Further, the catch element 2 has a cog or projection 24 which is engaged in notch-shaped recess 25 of the mounting block 23. When the catch clement 2 is pivoted, the cog 24 and the recess 25 form a pivotal center or axis.

In the embodiment according to FIGS. 10 to 13, a catch element 2' is designed as a slide which is mounted in a housing 26 and vertically movable therein. The housing 26 is fastened to the drawer frame 5, for example held by means of a screw which is screwable into a threaded member 27 in the housing 26 and clamps the housing 26 to the drawer frame 5. The housing 26 is further provided with a resilient flap 28 which presses the catch element 2' downwards into an engaged position thereof. The catch element 2', like the catch element 2, is provided with step-shaped stop surfaces 20. Two pins 29 limit the displacement path of the catch element 2' by abutting on frame members 30 of the housing 26. A release member 1' is directly molded to the catch element 2'. The release member 1' has a U-shaped or C-shaped configuration as viewed in the longitudinal direction of the pull-out rail 4, so that in a release position the release member does not impede the extraction of the pull-out rail 4 from the drawer frame 5.

FIGS. 13 and 14 show adjacent ends of the pull-out rail 4 and a hook member 19. The hook member 19 of the right drawer frame 5 is provided with a vertical flange 31 which extends into a corresponding slot 32 of the pull-out rail 4. Slot 32 is open towards the front. Thus, the pull-out rail 4 is positioned with respect to the side of the drawer. The left hook member 19 has a smaller flange 33 which abuts only one edge 34 of a recess 35 in rail 4. Thus, on such left side a lateral clearance of the pull-out rail 4 is possible. The left hook member 19 has at an inner end thereof a nose or protrusion 36 that also is received with clearance in a punched hole 37 in the pull-out rail 4. The nose 36 prevents unintentional extraction of the pull-out rail 4 from its locking position.

Figure 15:
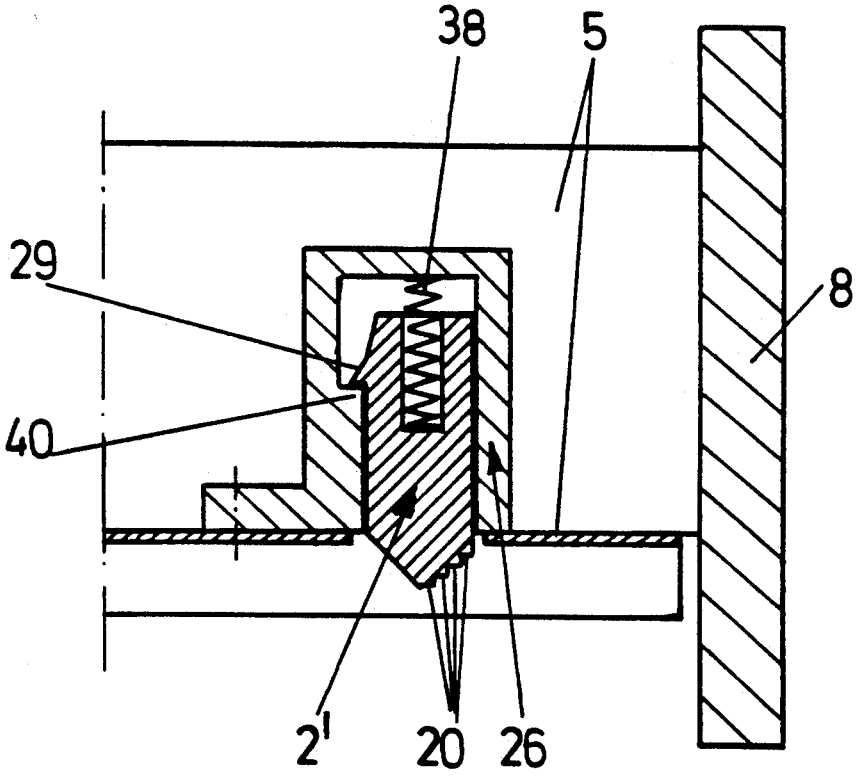
FIG. 15 a sectional side view of a further embodiment of the rail locking arrangement.

FIG. 15 shows a further embodiment of a catch element 2' that is designed as a slide which is received in a housing 26 of the drawer frame 5. The catch element 2' in this arrangement is acted upon by a spring 38 which is a coil spring in the illustrated embodiment. To prevent the catch element 2' or slide from being fully pressed out of the housing 26, catch element 2' is provided with a lateral nose or projection 29 which is pressed by the spring 38 against a stop 40 of the housing 26. The function of such catch element 2' is identical with the function of the catch elements 2 and 2' in the afore-described embodiments.

Figure 6:
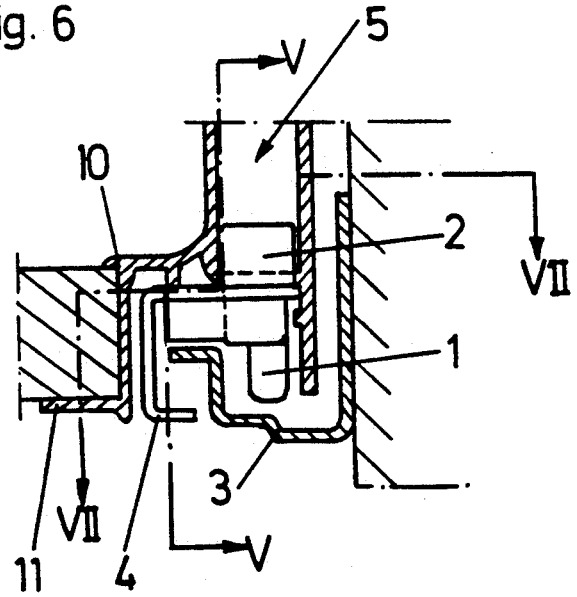
FIG. 6 shows a cross-sectional view of a lower region of a drawer frame along line VI—VI of FIG. 5.
Figure 7:
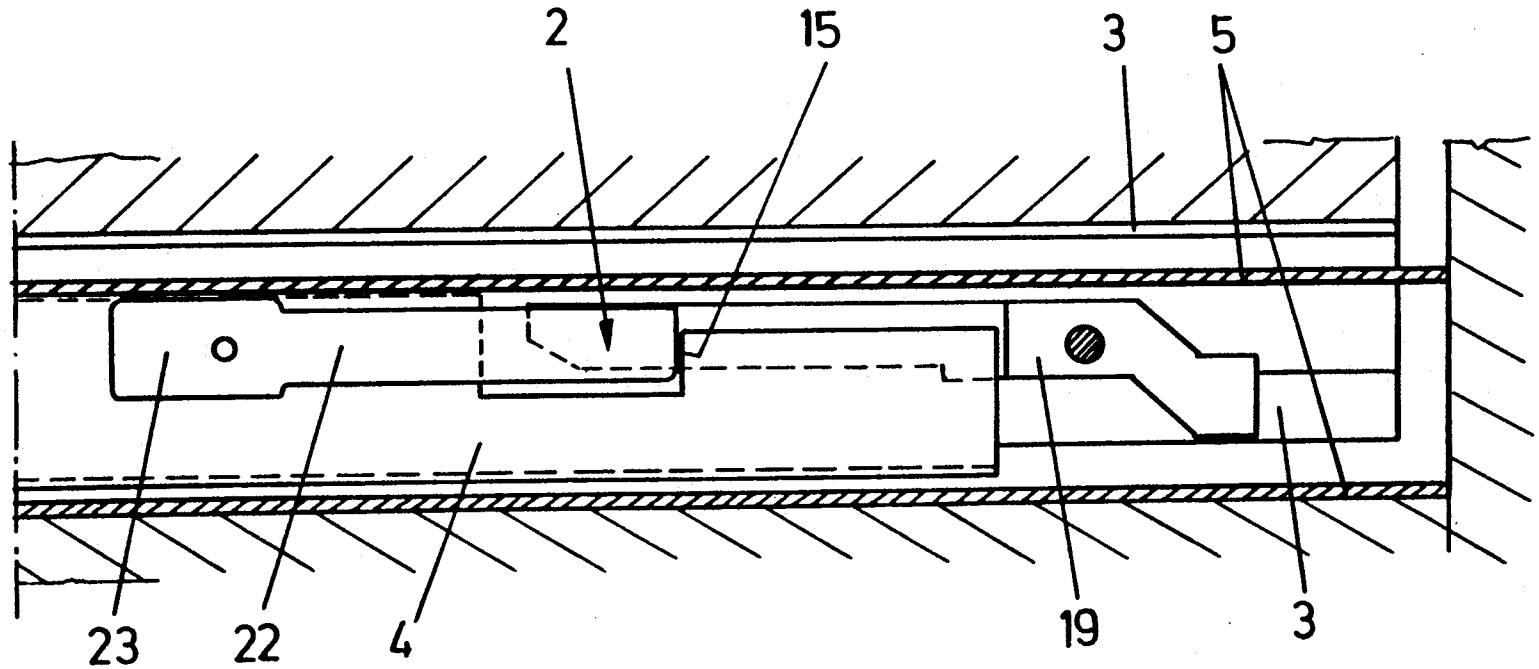
FIG. 7 a horizontal sectional view of the drawer frame in the region of the pull-out rail and of a catch element and a release member along line VII—VII of FIG. 6.

In FIG. 6 is shown a supporting rail 3 fastened to the body of an article of furniture. Known carriages with rollers or balls are not shown. The terms right and left as employed herein are relative to a person standing in front of the drawer and looking at it.

We claim:

1. In an arrangement including a drawer to be slidable into and out of an article of furniture, drawer guide assemblies on respective opposite sides of said drawer for guiding sliding movement of said drawer, each said drawer guide assembly including a pull-out rail to be slidable with said drawer during sliding movement thereof, and means for removably attaching said drawer to said pull-out rails so that said drawer may be removed from said pull-out rails without removing said pull-out rails from said drawer guide assemblies, the improvement wherein said means on at least one side of said drawer comprises:

said pull-out rail on said at least one side having a catch edge;

said drawer having on said at least one side thereof a catch element having formed thereon stop means for abutting said catch edge when said drawer is attached to said pull-out rail;

means for urging said catch element toward said pull-out rail so that said stop means will abut said catch edge; and said stop means comprising a plurality of stop surfaces that are staggered and offset relative to each other in a direction inclined to a direction of sliding movement of said drawer and to a longitudinal direction of said pull-out rail, thereby ensuring that one of said stop surfaces will align with an abut said catch edge.

2. The improvement claimed in claim 1, wherein said removably attaching means is the same on both sides of said drawer.

3. The improvement claimed in claim 1, further comprising means at a rear end of said pull-out rail for engaging said drawer.

4. The improvement claimed in claim 3, wherein said engaging means comprises a hook.

5. The improvement claimed in claim 1, further comprising means at a front end of said drawer for engaging a front end of said pull-out rail.

6. The improvement claimed in claim 5, wherein said engaging means comprises a hook member receiving said front end of said pull-out rail.

7. The improvement claimed in claim 5, wherein said engaging means comprises a vertical flange insertable into a slot in said pull-out rail.

8. The improvement claimed in claim 5, wherein said engaging means comprises a vertical flange abuttable with a lateral surface of said pull-out rail.

9. The improvement claimed in claim 5, wherein said engaging means comprises a protrusion fittable into a hole in said pull-out rail.

10. The improvement claimed in claim 1, wherein said catch edge is defined by a recess in said pull-out rail.

11. The improvement claimed in claim 1, wherein said urging means comprises a spring.

12. The improvement claimed in claim 1, wherein said urging means comprises a resilient member.

13. The improvement claimed in claim 1, further comprising release means mounted to selectively move said catch element in a direction opposite to the force of said urging means such that said catch edge no longer is aligned with any of said stop surfaces.

14. The improvement claimed in claim 13, wherein said release means comprises a member flexibly mounted on said drawer.

15. The improvement claimed in claim 14, wherein said release means in integral with a hook member mounted at a front end of said drawer for engaging a front end of said pull-out rail.

16. The improvement claimed in claim 13, wherein said release means is integral with said catch element.

17. The improvement claimed in claim 13, wherein said release means is positioned below said catch element.

18. The improvement claimed in claim 1, wherein said drawer includes opposite side frames, and said catch element is mounted on a respective said side frame.

19. The improvement claimed in claim 18, wherein said catch element is mounted within said side frame and projects through an opening therein.

20. The improvement claimed in claim 1, wherein said catch edge is defined by a recess formed in a reduced size portion of a horizontal flange of said pull-out rail.

21. The improvement claimed in claim 1, wherein said catch element is integrally connected to a mounting block mounted on said drawer by a flexible support arm.

22. The improvement claimed in claim 21, wherein said catch element has at an end thereof a cog pivotably fitting into a recess in said mounting block.

23. The improvement claimed in claim 1, wherein said catch element comprises a vertically movable member.

24. The improvement claimed in claim 23, further comprising a housing mounted on said drawer, and wherein said catch element is vertically movably mounted in said housing.

25. The improvement claimed in claim 24, wherein said urging means is on said housing and urges said catch element vertically downwardly relative thereto.

26. The improvement claimed in claim 25, wherein said urging means comprises a resilient member attached to or integral with said housing.

27. The improvement claimed in claim 24, wherein said urging means comprises a spring mounted within said housing and urging said catch member vertically downwardly relative thereto.

28. The improvement claimed in claim 24, wherein said catch element includes means for limiting vertical movement thereof relative to said housing.

* * * * *